US007510099B2

(12) United States Patent
Knoth et al.

(10) Patent No.: US 7,510,099 B2
(45) Date of Patent: Mar. 31, 2009

(54) CASSETTE FOR DISPENSING PILLS

(75) Inventors: Norman D. Knoth, Clearwater, FL (US); Jeffrey A. Johnsey, St. Petersburg, FL (US)

(73) Assignee: QEM, Inc., Largo, FL (US)

( * ) Notice: Subject to any disclaimer, the term of this patent is extended or adjusted under 35 U.S.C. 154(b) by 493 days.

(21) Appl. No.: 11/317,538

(22) Filed: Dec. 23, 2005

(65) Prior Publication Data

US 2007/0145066 A1 Jun. 28, 2007

(51) Int. Cl.
*B65H 3/00* (2006.01)

(52) U.S. Cl. ..... 221/265; 221/208; 221/263; 221/264; 221/277; 221/224; 221/236; 221/237

(58) Field of Classification Search ..... 221/1–312 C
See application file for complete search history.

(56) References Cited

U.S. PATENT DOCUMENTS 2,690,856 A 10/1954 Trondle
3,064,406 A * 11/1962 Kennedy et al. ..... 53/240
3,722,740 A * 3/1973 List ..... 221/7
3,871,156 A * 3/1975 Koenig et al. ..... 53/501
4,150,766 A * 4/1979 Westendorf et al. ..... 221/112
4,191,308 A * 3/1980 Allen et al. ..... 221/202
4,903,861 A 2/1990 Yuyama
5,219,095 A * 6/1993 Shimizu et al. ..... 221/264
5,865,342 A * 2/1999 Ito et al. ..... 221/265
6,208,911 B1 3/2001 Yamaoka et al.
6,256,963 B1 7/2001 Kim
6,394,308 B1 * 5/2002 Yuyama et al. ..... 221/265
6,497,342 B2 * 12/2002 Zhang et al. ..... 221/265
6,948,635 B2 * 9/2005 Kobayashi ..... 221/264
7,219,703 B2 * 5/2007 Geltser et al. ..... 141/130
2005/0230413 A1 10/2005 Kim

* cited by examiner

*Primary Examiner*—Gene Crawford
*Assistant Examiner*—Michael K Collins
(74) *Attorney, Agent, or Firm*—Larson & Larson; Frank Liebenow

(57) ABSTRACT

A cassette for dispensing pills whereby the cassette is coupled to a drive motor that operates in continuous revolution and the internal gears of the cassette translate the continuous motion into a stepping motion, whereby at each step, a system of turning members permit one pill to drop from the cassette into a target container.

15 Claims, 6 Drawing Sheets

CASSETTE FOR DISPENSING PILLS

BACKGROUND OF THE INVENTION

This application is related to U.S. application titled, "MACHINE TO AUTOMATE DISPENSING OF PILLS," which was filed on even date herewith; Ser. No. 11/318,186 and inventor Norman D. Knoth.

FIELD OF THE INVENTION

The present invention relates to the field of dispensing solid pharmaceuticals and more particularly to an apparatus that stores pills or capsules and provides for accurately dispensing the same.

DESCRIPTION OF THE RELATED ART

There have been many approaches to dispensing medicine in pill form. U.S. Pat. No. 2,690,856 to Trondle filed Dec. 3, 1951 describes a drum method whereby a large drum would hold a supply of pills and a rotary base for dispensing the pills.

U.S. Pat. No. 4,903,861 to Yuyama, filed Dec. 29, 1988 is hereby incorporated by reference. It describes a feeder for dispensing capsules whereby the capsules are guided into channels in a rotor and the capsules are discharged one by one each time the pocket aligns with a feed opening in a bottom plate. Unfortunately, if the capsule is slow to clear the pocket, it can get sliced or cause the rotor to jam. Additionally, it is possible for more than one capsule to escape at the same time.

U.S. Pat. No. 6,208,911 to Yamaoka, filed Dec. 23, 1997 is hereby incorporated by reference. It describes a solid drug filling apparatus whereby a rotary plate with a plurality of receiving sections, whereby the tablets rest. Discharge orifices are formed through the bottom portion of the receiving sections. A shutter opens or closes the orifice releasing the tablet. Unfortunately, if the tablet is slow to clear the orifice, it can get sliced or cause the shutter to jam. Additionally, it is possible for more than one tablet to escape at the same time.

U.S. Pat. No. 6,256,963 B2 to Kim, filed Oct. 23, 2000 is hereby incorporated by reference. It describes a cassette for sorting and counting tablets. It has a drum with a plurality of teeth whereby the tablets are guided into teeth of the drum and fall into a bin as the drum rotates. Unfortunately, the tablets can jam when entering the teeth of the drum or jam between the teeth of the drum and the wall of the cassette.

US Patent Publication 2005/0230413 A1 to Kim, filed Jan. 12, 2005 is hereby incorporated by reference. It describes a cassette for dispensing capsules with a passage at one end and a discharge driver that is a conic rotating body within the cassette with divisions on the outer circumference and is turned by a motor. Unfortunately, jamming is an issue, in that the abstract conveys that the motor can be reversed to clear jams. Additionally, it is possible for more than one capsule to escape at the same time.

What is needed is an apparatus that will store pills, capsules, tablets or the like; and dispense at a rate that can be accurately counted and can dispense them with minimal breakage.

SUMMARY OF THE INVENTION

An object of the present invention is to provide a device that will store pills and capsules.

Another objective of the present invention is to provide a device that accurately dispenses pills and capsules while limiting damage or breakage of the pills and capsules.

In one embodiment, a cassette for storing and dispensing pills is disclosed including an enclosure having a removable lid adapted to allow the introduction of the pills into the enclosure. A cassette vane top ring is situated at a bottom end of the enclosure such that gravity urges the pills through a central opening in the cassette vane top ring and into pill vanes in the top surface of a dome-shaped cassette vane. Below the cassette vane is a cassette vane bottom finish with a plurality of pill indexes. Beneath the cassette vane bottom finish is a pill vane plate for supporting the pills within the pill indexes, preventing them from falling until they pass over a pill drop opening in the pill vane plate. A partition is situated between the cassette vane bottom finish and the pill vane plate over the pill drop opening to prevent the pills from falling from the pill vanes into the pill drop opening. A gear system couples a drive wheel to the cassette vane bottom finish and to the cassette vane and is adapted to rotate the cassette vane bottom finish and to the cassette vane in a rotate/pause movement in response to a continuous rotation of the drive wheel.

In another embodiment, a method for dispensing pills is disclosed including storing the pills above a dome-shaped cassette vane, the cassette vane including pill vanes. Then, urging the pills into the pill vanes by gravity and turning a drive wheel in continuous movement. The continuous movement of the drive wheel is converted into a start/stop movement of a vane shaft and the vane shaft is coupled to the cassette vane and a cassette vane bottom finish allowing one of the pills to drop from each pill vane into each of a plurality of pill indexes within the cassette vane bottom finish, the cassette vane bottom finish turning in step with the cassette vane and the pills supported by a pill vane plate under the cassette vane bottom finish. This allows one pill to drop out of one of the pill indexes into a pill drop opening for each rotation of the drive wheel and a partition between the pill vane plate and the pill index located over the pill drop opening prevents more than one of the pills from dropping.

In another embodiment, a cassette for storing and dispensing pills is disclosed including an enclosure for storing the pills having a removable lid. A cassette vane top ring is situated at a bottom end of the enclosure such that gravity urges the pills through a central opening in it and into a plurality of pill vanes disposed in the top surface of a cassette vane. A cassette vane bottom finish with a plurality of pill indexes is situated below the cassette vane. A pill vane plate is situated beneath the cassette vane bottom finish and is adapted to support the pills within the pill indexes, preventing the pills from falling until the pills pass over an opening in the pill vane plate. A partition is situated between the cassette vane bottom finish and the opening, preventing the pills from falling from the pill vanes into the opening. A gear is adapted to couple a drive wheel to the cassette vane bottom finish and to the cassette vane. The gear rotates the cassette vane bottom finish and the cassette vane in a rotate/pause movement in response to a continuous rotation of the drive wheel.

In another embodiment, means for dispensing pills is disclosed including a device for storing the pills, a device for accepting a continuous rotation and for converting the continuous rotation into a rotate/pause sequence and a device for indexing the pills to allow only one pill to drop through an opening on each rotate/pause sequence.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
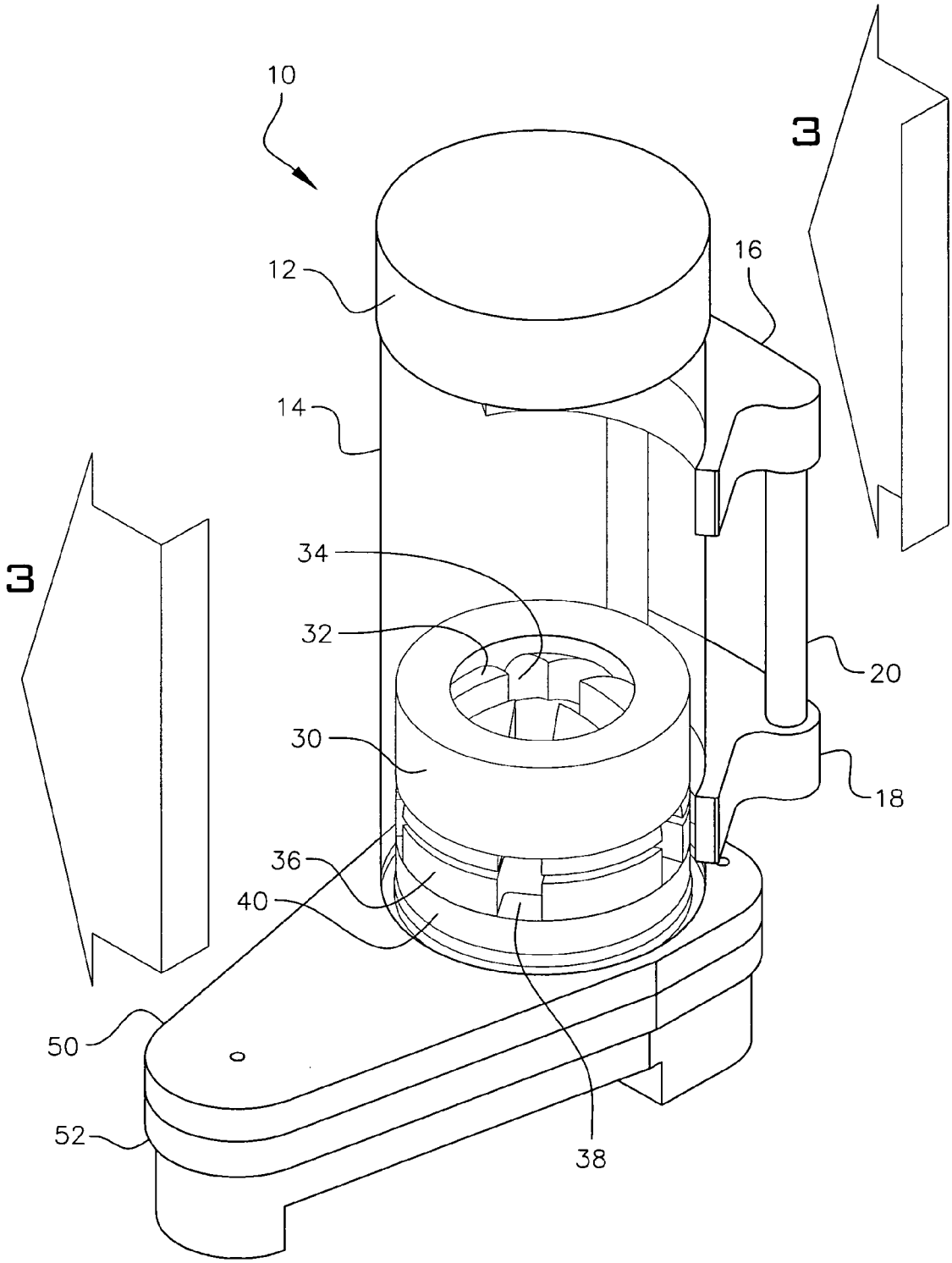
FIG. 1 illustrates a perspective view of the cassette of the present invention.

Reference will now be made in detail to the presently preferred embodiments of the invention, examples of which are illustrated in the accompanying drawings. Throughout the following detailed description, the same reference numerals refer to the same elements in all figures. Throughout the description (including the claims), the description discusses dispensing pills. For the purpose of this application, the word pill is used to represent anything that can be dispensed by the device of the present invention and there is no limitation placed upon that which is dispensed. For example, tablets, capsules, caplets and gel-caps can be dispensed as well as coated candy and marbles. The present invention works well with most any solid object and can be scaled to work for much larger objects as well.

Referring to FIG. 1, a perspective view of the cassette of the present invention is shown. The cassette 10 has a substantially cylindrical cassette tube 14, preferably made from a transparent material such as glass or acrylic plastic, such that the remaining supply of pills within the cassette is readily visible. A cassette lid 12 is removably attached to the top of the cassette tube 14 to prevent spillage of pills. One or more handles 20 are held in place between two holder brackets 16/18 providing a grip to hold the cassette 10 and assist in removing the cassette 10 from a carousel (not shown). The cassette vane top ring 30 provides support for the weight of the pills within the cassette tube 14 and funnels the pills towards the cassette vane 32 and into the individual pill vanes 34 and consequently, into the pill index 38 of the cassette vane bottom finish 36. The cassette vane top ring 30 is angled toward the center to allow pills to travel toward the individual pill vanes 34 by the force of gravity. In the preferred embodiment, the top surface of the cassette vane top ring 30 is conically shaped so that it supports the weight of the pills above it while channeling the pills into the pill vanes 34. In most embodiments, the bottom surface of the cassette vane top ring 30 conforms to the shape of the top of the cassette vane 34. Pills rest on top surface of the pill vane plate 40. The base of the cassette 10 is made from a cassette body cover 50 and a cassette body 52. In the preferred embodiment, the pill handling parts are made of a smooth, non-absorbent material such as nylon or Teflon, allowing the pills to flow smoothly while preventing buildup of contaminants from powders present in the pill supply. The cassette body cover 50 and the cassette body 52 are preferably made of a structural material such as steel or hard plastic and held together with fasteners.

Figure 2:
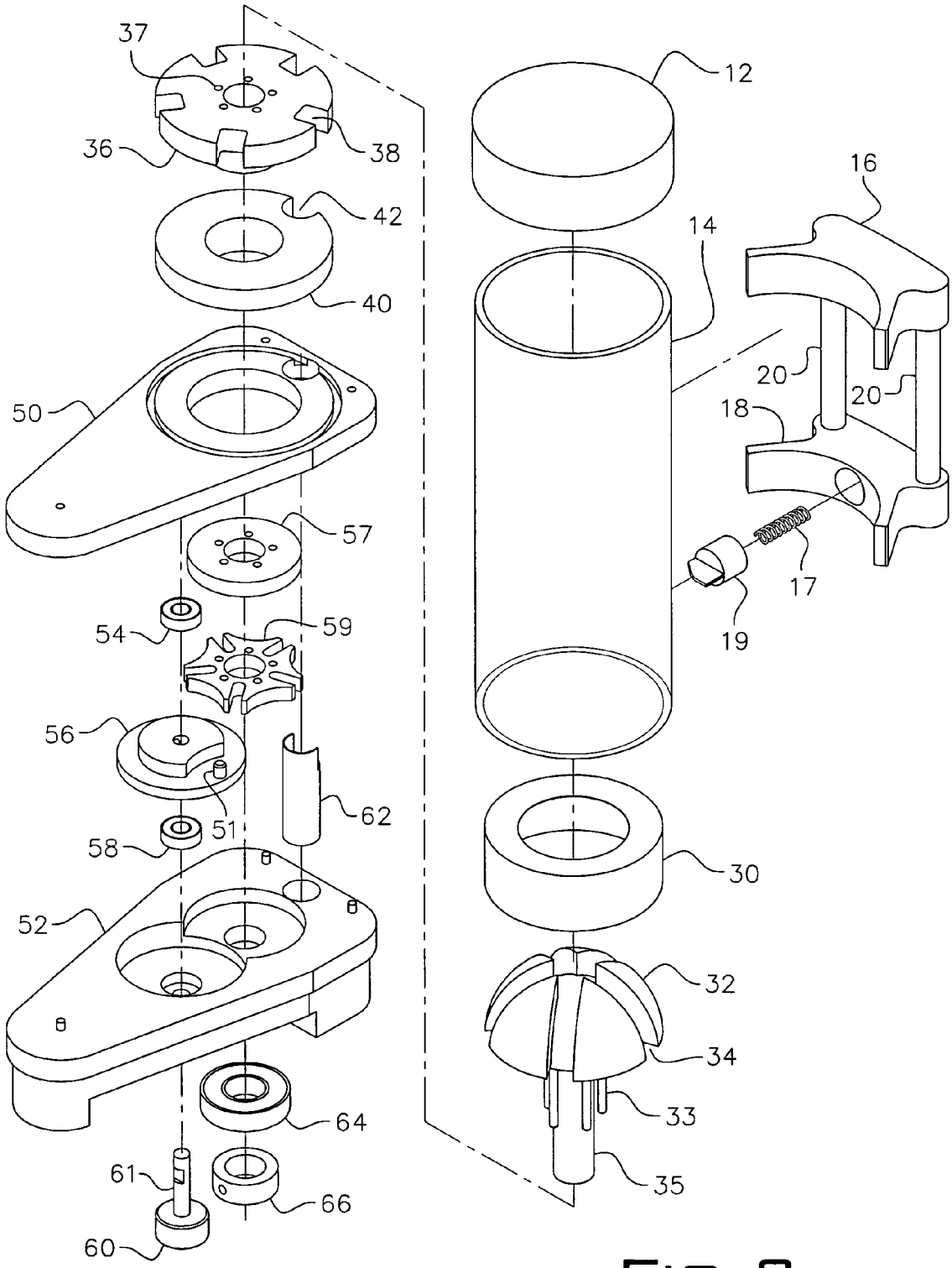
FIG. 2 illustrates an exploded view of the cassette of the present invention.

Referring to FIG. 2, an exploded view of the cassette of the present invention is shown. The cassette 10 has a substantially cylindrical cassette tube 14, preferably made from a transparent material such as glass or acrylic plastic, such that the remaining supply of pills within the cassette tube 14 is readily visible. A lid 12 is removably attached to the top of the cassette tube 14 to prevent spillage of pills. Handles 20 are held in place between two holder brackets 16/18 providing a grip to hold the cassette 10 and assist in removing the cassette from a carousel (not shown). Integrated into the bottom holder bracket 18 is a partition 19 that is spring-loaded by spring 17. The cassette vane top ring 30 provides support for the weight of the pills within the cassette tube 14 and funnels the pills towards the cassette vane 32 and into the individual pill vanes 34 and consequently, into the pill index 38 of the cassette vane bottom finish 36. The pills rest on top of the pill vane plate 40. As will be shown, the pill travels around the top of the vane plate 40 within one of the pill indexes 38 of the cassette vane bottom finish 36 until it reaches the pill drop opening 42, at which time it drops through the pill drop tube 62. The partition 19 keeps pills that are above the pill drop opening 42 (in the pill index 38) from dropping when the pill index 38 coincides with the pill drop opening 42. The partition 19 is held in place with a spring 17, such that if a pill mis-registers, the spring 17 allows the partition 19 to move, preventing the mis-registered pill from dropping and preventing jamming the cassette 10.

The cassette vane 32, the cassette vane bottom finish 36 and the drive gear-B 59 are held in relationship to each other by the sync pins 33 emanating from the cassette vane 32 and passing through holes 37 in the cassette vane bottom finish 36. The drive gear-B 59 interfaces with the drive gear-A 56 with a drive gear-A pin 51. The drive gear-A 56 is driven by the drive pin 61 that turns with the drive wheel 60. The drive pin 61 passes through the cassette body 52, a bearing 58, the drive gear-A 56 and another bearing 54 and is held in place by the cassette body cover 50.

The vane shaft 35 passes through the cassette vane bottom finish 36; the vane plate 40; the cassette body cover 50; the drive spacer 57; the drive gear-B 59; the cassette body 52; and a bearing 64. The vane shaft 35 is held in place by a shaft collar 66.

Figure 3:
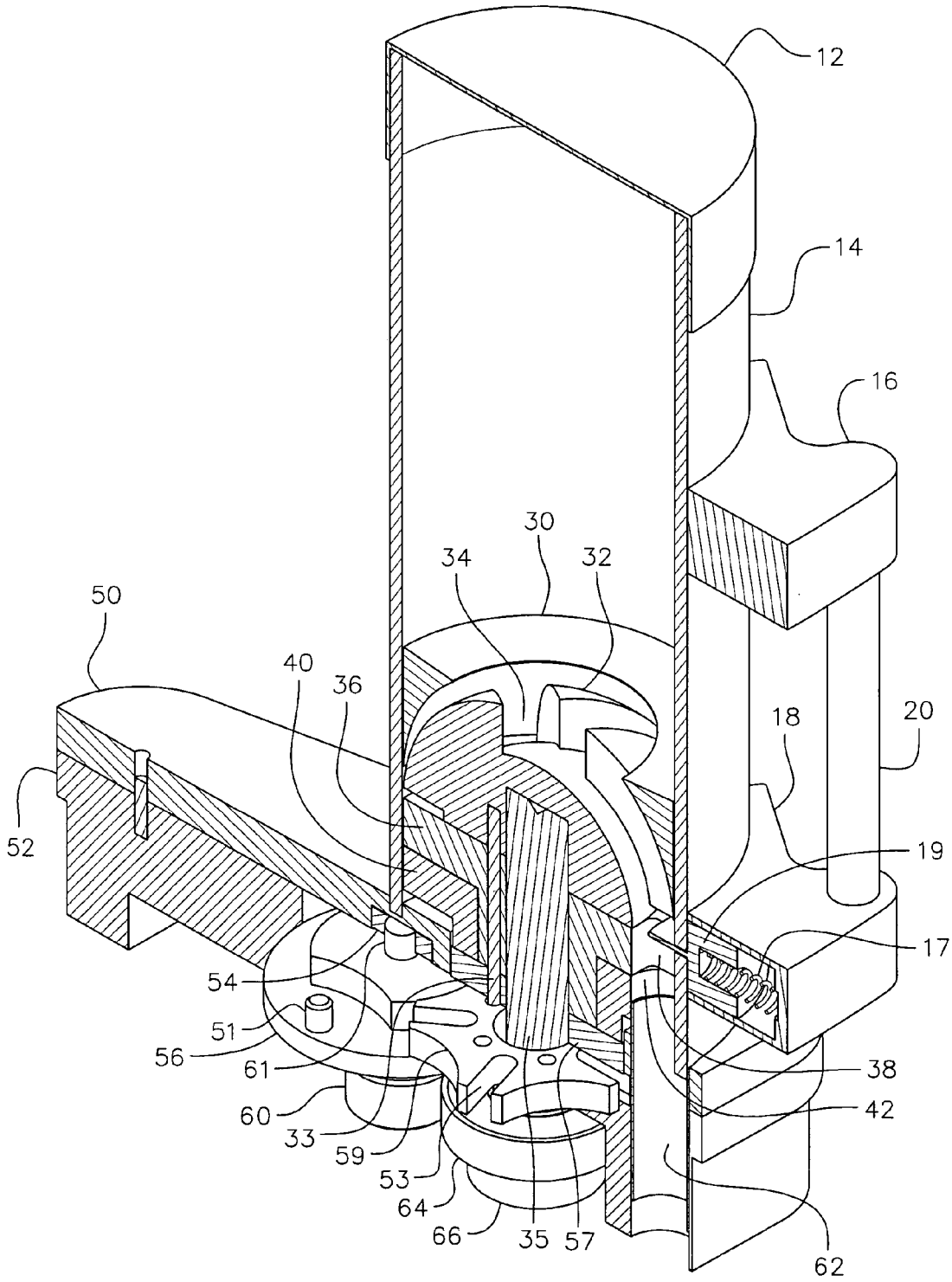
FIG. 3 illustrates a sectional view of the cassette along cut lines 3-3 of FIG. 1.

Referring to FIG. 3, a sectional view of the cassette along cut lines 3-3 of FIG. 1 is shown. The cassette 10 has a substantially cylindrical cassette tube 14, preferably made from a transparent material such as glass or acrylic plastic, such that the remaining supply of pills within the cassette tube 14 is readily visible. A lid 12 is removably attached to the top of the cassette tube 14 to prevent spillage of pills. A handle 20 is held in place between two holder brackets 16/18 providing a grip to hold the cassette 10 and assist in removing the cassette from a carousel (not shown). Integrated into the bottom holder bracket 18 is a partition 19 that is spring-loaded by spring 17. The cassette vane top ring 30 provides support for the weight of the pills within the cassette tube 14 and funnels the pills towards the cassette vane 32 and into the individual pill vanes 34 and consequently, into the pill index 38 of the cassette vane bottom finish 36. The pills rest on top of the pill vane plate 40. As will be shown, the pill travels around the top of the vane plate 40 within one of the pill indexes 38 of the cassette vane bottom finish 36 until it reaches the pill drop opening 42, at which time it drops through the pill drop tube 62. The partition 19 keeps pills that are above the pill drop opening 42 (in the pill index 38) from dropping when the pill index 38 coincides with the pill drop opening 42. The partition 19 is held in place with a spring 17, such that if a pill mis-registers, the spring 17 allows the partition 19 to move, preventing the mis-registered pill from dropping and preventing jamming the cassette 10.

Vane shaft 35 passes through the cassette vane bottom finish 36, the vane plate 40, the cassette cover 50, the drive spacer 57, the drive gear-B 59, the cassette body 52 and a bearing 64; and the vane shaft 35 is held in place by a collar 66. The cassette vane 32, the cassette vane bottom finish 36 and the drive gear-B 59 are held in relationship to each other by the sync pins 33 emanating from the cassette vane 32. The drive gear-B 59 interfaces with the drive gear-A 56 which is driven by the drive pin 61 that turns with the drive wheel 60. The drive pin 61 passes through the cassette body 52, a bearing 58 (not visible), the drive gear-A 56 and another bearing 54 and is held in place by the cassette body cover 50.

Drive gear-A 56 and drive gear-B 59 with drive gear-A pin 51 and drive gear-B slots 53 comprise a gearing system that provides an indexed rotate/pause motion to the cassette vane 32. In the preferred embodiment, these gears 56/59 form what is known as a Geneva drive mechanism. The Geneva drive mechanism has a function to convert continuous rotation into intermittent rotation (rotate/pause) by a set angle. That is, when a continuous rotation is inputted, the Geneva drive mechanism outputs an alternate repetition of rotation and stoppage, i.e. a rotation through a set angle followed by a stopping period, and then a rotation through the same set angle. Generally, a Geneva drive mechanism includes a driven member defining arcuate recesses and radially outwardly opening slots arranged alternately at predetermined intervals around the driven member and a driving member for intermittently rotating the driven member. An example of a Geneva drive mechanism is disclosed in Japanese Utility Model Publications Kokai No. S60-64357 and No. H6-40507 as an example.

In the preferred embodiment, the Geneva drive translates a continuous turning motion of the drive wheel 60 into a rotate/pause motion in which the cassette vane 32 will turn until one pill index 38 is positioned above the pill drop opening 42, then the cassette vane 32 will stop, allowing the pill to fall by gravitational forces. It is important the pill index 38 stops for an interval for several reasons. The first is to allow the pill to completely clear the interface between the cassette vane bottom finish 36 and the vane plate 40 so that the pill isn't crushed or so the pill doesn't cause a jam. Second, the stopping motion allows for exactly one pill to drop, thereby permitting a more accurate count of pills being dispensed, perhaps by a photo sensor coupled with the pill drop tube 62.

Figure 4:
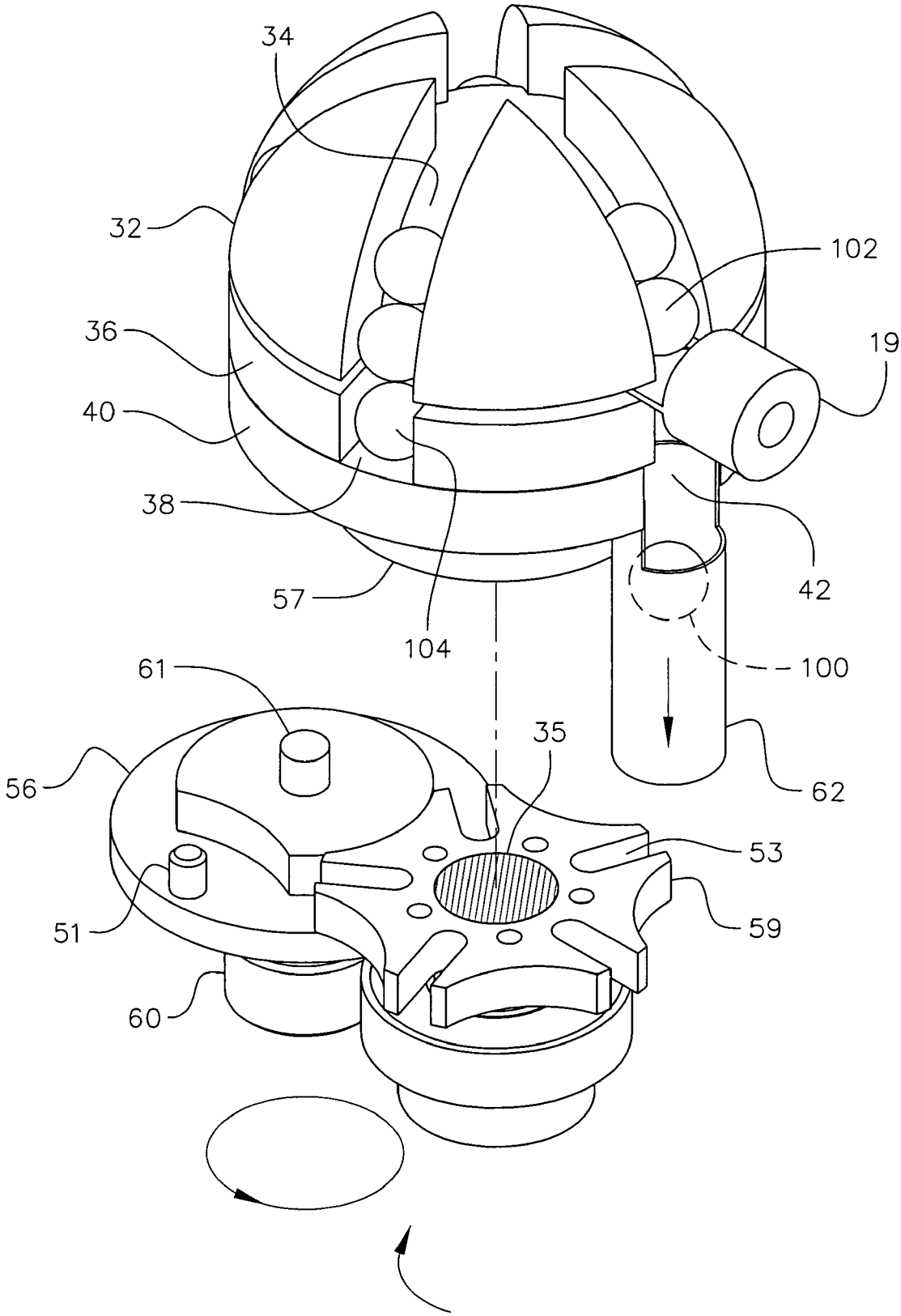
FIG. 4 illustrates a first operational perspective of the vane and gear system of the present invention.
Figure 5:
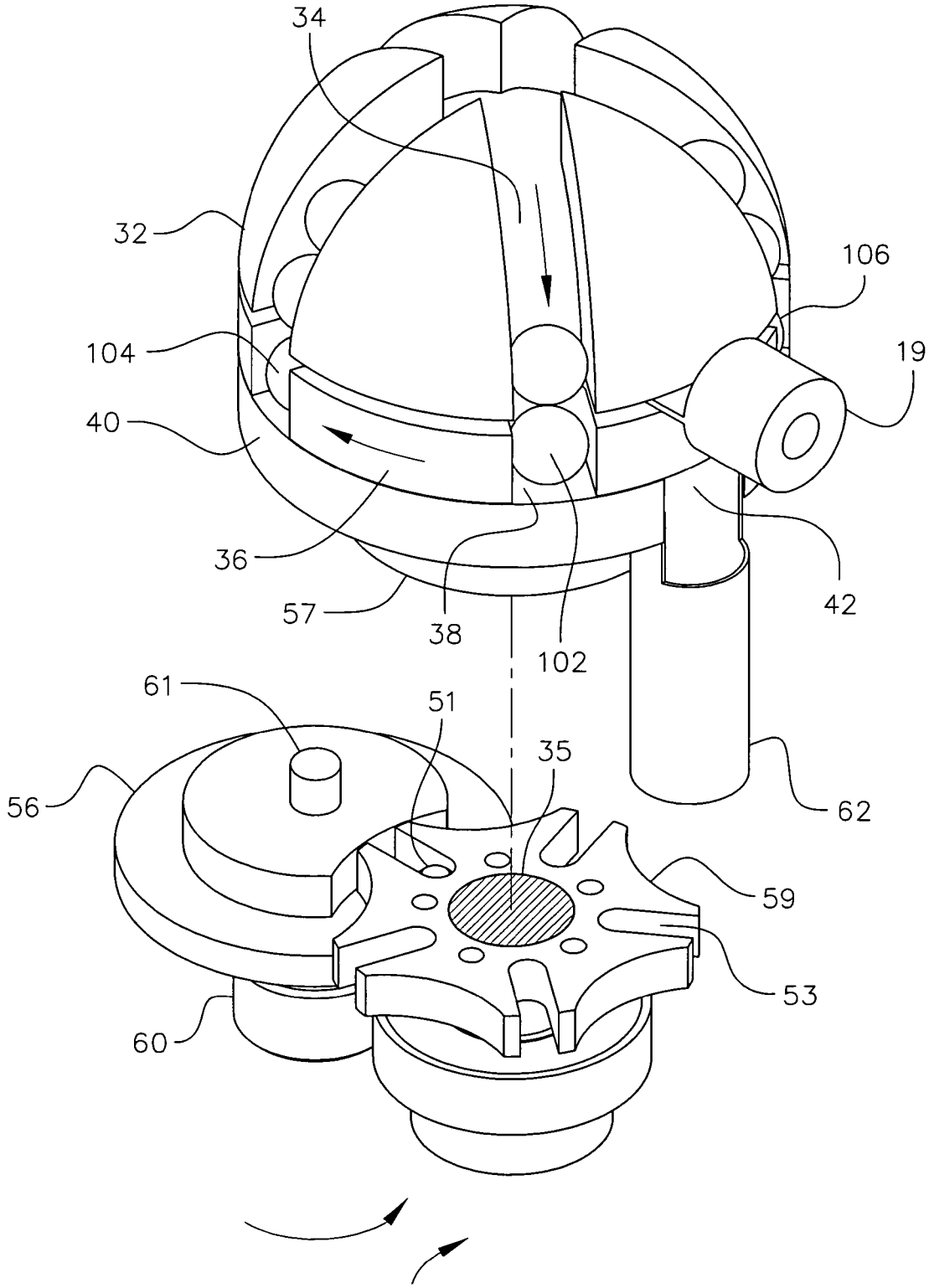
FIG. 5 illustrates a second operational perspective of the vane and gear system of the present invention.
Figure 6:
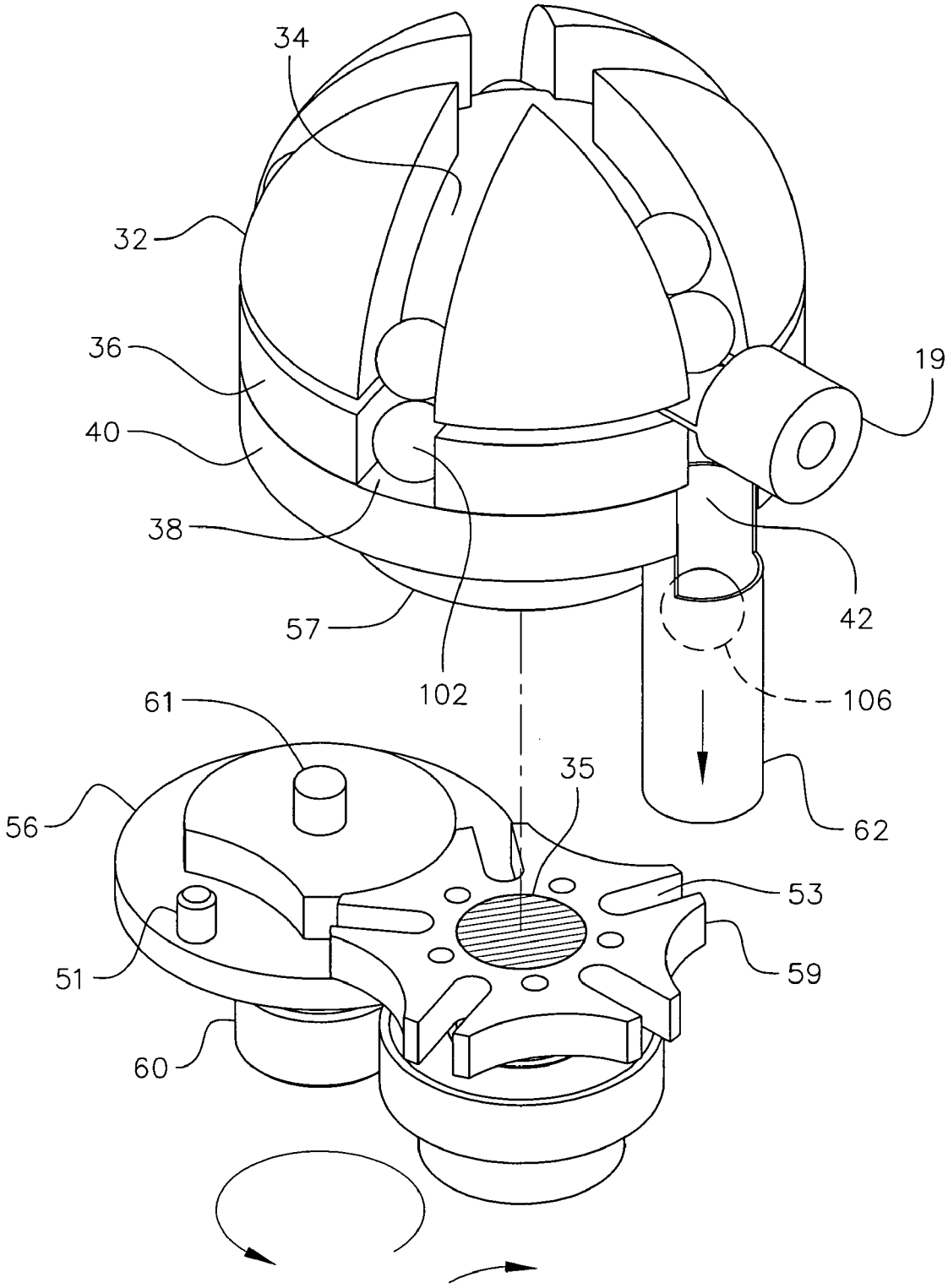
FIG. 6 illustrates a third operational perspective of the vane and gear system of the present invention.

Referring to FIG. 4-6, a first, second and third operational perspective of the vane and gear system of the present invention is shown. In FIG. 4, the drive gear-A 56 continuously rotates while pills are being dispensed and is driven by a motor (not shown) coupled to it by the drive wheel 60 and the drive shaft 61. As shown in FIG. 4, the drive gear-A 56 has rotated one full turn and drive gear-B 59 has rotated $1/5^{th}$ of a turn which occurred when the drive peg 51 was positioned in one of the five drive gear-B slots 53, so drive gear-B 59 is currently stopped and a pill 100 is dropping from a pill index 38 through the pill drop opening 42 and through the pill drop tube 62. The drive spacer 57, cassette vane bottom finish 36 and cassette vane 32 are also stopped since they are coupled by the vane shaft 35. Note the position of pill 104 which is within a pill index 38 and resting upon vane plate 40. Pill 102, which is within a pill vane 34 of the cassette vane 32, is prevented from dropping by the partition 19.

Continuing with FIG. 5, the drive gear-A 56 has rotated another $1/5^{th}$ of a turn and the pin 51 has engaged with the drive gear-B 59 slot 53, forcing the drive gear-B 59 to rotate, shown rotated $1/10^{th}$ of a rotation from its position in FIG. 4. Since the pill 102 is no longer over the partition 19, it has dropped into a pill index 38 and a pill 104 has traveled $1/10^{th}$ of a rotation. A pill 106 is now partially in view and is rotating towards the drop position. As the drive gear-A 56 continues to turn; drive gear-B 59 continues its $1/5^{th}$ of a turn until the pin 51 disengages the slot 53 as shown in FIG. 6. At this point in the rotation, the pill 106 is positioned over the pill drop opening 42 and drops through the pill drop tube 62. This process continues until the requested number of pills drop, at which time the drive motor (not shown) is stopped and drive gear-A 56 stops turning and hence, no more pills are released.

It can be seen that the motor stop time is not critical, in that, the time from the completion of a $1/5^{th}$ turn of drive gear-B 59 until the pill drop is counted and the power to the motor is withdrawn and inertial movement of the motor and drive stops, the motor is allowed to rotate drive gear-A up to at least 288 degrees because no subsequent pills will even start moving toward the pill drop opening 42 until it reaches that position. Furthermore, the drive gear-A can continue even further, in that the pill will not drip until the pill index 38 rotates far enough for the pill to be located over the pill drop opening 42. Therefore, the Geneva drive mechanism provides accurate pill dispensing without the requirement for expensive servo motors with elaborate breaking systems.

Although shown with five gear teeth, providing one pill drop per revolution of the drive wheel 60, the present invention is not limited to five. For example, in an alternate embodiment, a six tooth gear is used. In that embodiment, the cassette vane 32 has six pill vanes 34 and the cassette vane bottom finish has six pill indexes 38. In other embodiments, the number of gear teeth is not equal to the number of pill indexes 38 (and pill vanes 34). For example, in some embodiments, there may be six gear teeth and only three evenly spaced pill vanes 34 and pill indexes 38. In that embodiment, one pill would drop for every two revolutions of the drive wheel 60. Furthermore, in some embodiments, there are more than one pill drop openings 42 and an equal number of pill drop tubes 62. For example, using a 6-tooth gear and two pill drop openings 42, two pills drop every rotation of the drive wheel 60.

In some embodiments, the pill vane 34 and pill index 38 are sized for a particular pill dimension, to assure only one pill fits in each pill vane and to assure the pill does not extend above the top of the cassette vane bottom finish 36, whereby it may jam as the cassette vane bottom finish 36 rotates the pill into the drop position. Both the width of the pill vane 34/pill index 38 and the thickness of the cassette vane bottom finish 36 are sized to accommodate the pill dimension. The pill drop opening 42 and pill drop tube 62 only need be large enough to accommodate the largest pill dimension and, therefore, need not be sized differently for different pill dimensions.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A cassette for storing and dispensing pills, the cassette comprising:

an enclosure having a removable lid adapted to allow the introduction of the pills into the enclosure;

a cassette vane top ring situated at a bottom section of the enclosure such that gravity urges the pills through a central opening in the cassette vane top ring and into pill vanes, the pill vanes disposed in a top surface of a dome-shaped cassette vane;

a cassette vane bottom finish below the cassette vane, the cassette vane bottom finish having a plurality of pill indexes, each of the pill indexes sized to accept one pill of the pills;

a pill vane plate beneath the cassette vane bottom finish adapted to support the pills within the pill indexes, preventing the pills within the pill indexes from falling until one of the pills within the pill indexes pass over a pill drop opening in the pill vane plate;

a partition between the cassette vane bottom finish and the pill vane plate, covering the pill drop opening and preventing the pills from falling from the pill vanes into the pill drop opening; and a gear system coupling a drive wheel to the cassette vane bottom finish and the cassette vane, the gear system adapted to rotate the cassette vane bottom finish and the cassette vane in a rotate/pause movement in response to a continuous rotation of the drive wheel.

2. The cassette of claim 1, wherein the enclosure is cylindrical in shape and is made of a transparent material.

3. The cassette of claim 1, wherein the cassette vane top ring is conical in shape.

4. The cassette of claim 1, wherein the gear system is a Geneva gear drive.

5. The cassette of claim 1, further comprising a pill drop tube situated directly beneath the pill drop opening for guiding the pills.

6. The cassette of claim 1, further comprising a spring coupled to the partition enabling the partition to bend out of the way when one of the pills mis-registers, thereby preventing a jam.

7. The cassette of claim 1, wherein the cassette vane, cassette vane bottom finish and an output gear of the gear system are held in synchronization by a plurality of sync pins.

8. The cassette of claim 1, wherein the gear system is configured such that the cassette vane bottom finish turns ⅕ of a turn for each full turn of the drive wheel and one of the pills drops through the pill drop opening for each ⅕ turn of the cassette vane bottom finish.

9. A cassette for storing and dispensing pills, the cassette comprising:

an enclosure means for storing the pills, the enclosure means having a removable lid means;

a cassette vane top ring means situated at a bottom end of the enclosure means such that gravity urges the pills through a central opening in the cassette vane top ring means and into a plurality of pill vanes, the plurality of pill vanes disposed in the top surface of a cassette vane;

a cassette vane bottom finish below the cassette vane, the cassette vane bottom finish having a pill indexing means;

a pill vane plate beneath the cassette vane bottom finish adapted to support the pills within the pill indexing means, preventing the pills from falling until the pills pass over an opening means in the pill vane plate;

a partition means between the cassette vane bottom finish and the opening means for preventing the pills from falling from the pill vanes into the opening means; and a gear means adapted to couple a drive wheel to the cassette vane bottom finish and to the cassette vane, the gear means adapted to rotate the cassette vane bottom finish and to rotate the cassette vane in a rotate/pause movement in response to a continuous rotation of the drive wheel.

10. The cassette of claim 9, wherein the enclosure means is cylindrical in shape and the enclosure means is made from a clear material.

11. The cassette of claim 9, wherein the gear means is a Geneva gear drive.

12. The cassette of claim 9, further comprising a pill drop tube situated directly beneath the opening means for guiding the pills.

13. The cassette of claim 9, wherein the partition means includes a spring allowing the partition to bend out of the way when one of the pills mis-registers, thereby preventing a jam.

14. The cassette of claim 9, wherein the cassette vane, cassette vane bottom finish and an output gear of the gear means are held in synchronization by a plurality of sync pins.

15. The cassette of claim 9, wherein the gear means is configured such that the cassette vane bottom finish turns ⅕ of a turn for each full turn of the drive wheel and for each turn of the drive wheel, one of the pills drops through the opening means.

* * * * *